United States Patent [19]

Allia

[11] Patent Number: 4,561,667

[45] Date of Patent: Dec. 31, 1985

[54] SAILBOARDING EQUIPMENT VEHICLE

[76] Inventor: Frank S. Allia, 22 Forest Way, Essex Fells, N.J. 07021

[21] Appl. No.: 647,053

[22] Filed: Sep. 4, 1984

[51] Int. Cl.[4] ..... B62B 1/18

[52] U.S. Cl. ..... 280/47.13 B; 114/39; 114/344; 280/47.26; 280/47.33

[58] Field of Search ..... 114/39.2, 344; 292/63, 292/67; 280/47.13 B, 414.2, 47.19, 47.24, 47.26, 763.1, 47.33

[56] References Cited

U.S. PATENT DOCUMENTS 2,532,966 12/1950 Thomas ..... 280/47.33
4,316,615 2/1982 Willette ..... 280/47.26

FOREIGN PATENT DOCUMENTS 2633149 1/1978 Fed. Rep. of Germany ... 280/47.13 B
2488205 2/1982 France ..... 280/47.13 B

*Primary Examiner*—Joseph F. Peters, Jr.
*Assistant Examiner*—Michael Mar
*Attorney, Agent, or Firm*—Howard E. Thompson, Jr.

[57] ABSTRACT

A sailboarding equipment vehicle is provided in the form of a rackcart comprising an upstanding frame elongated at the base in a forward to rearward direction with spaced wheels at the forward end and a kick stand at the rear end of the base, the upstanding portion of the frame being offset slightly from the vertical to provide inclined support for a sailboard having a center edge portion resting on the base of the frame, the upper portion of the frame having an elongated tubular part supporting a longer rotatable member extending front to rear of the frame with a hand grip portion protruding from the rear of the frame, clamp member joined to the rotatable member at portions thereof externally of the tubular part protruding from the board side of the frame having a downwardly offset portion providing a board clamp in one position of rotation thereof, the rotatable member being releasably secured in different positions of rotatable adjustment, outer extremities of the board clamp member providing hook portions for suspending equipment from the frame, and the upwardly inclined portion of the frame opposed to the board engaging portion thereof having vertically spaced members extending longitudinally of the frame, providing boom and mast racks, whereby all equipment needed for sailboarding can be mounted on, and transported by, the vehicle.

10 Claims, 11 Drawing Figures

FIG. 1
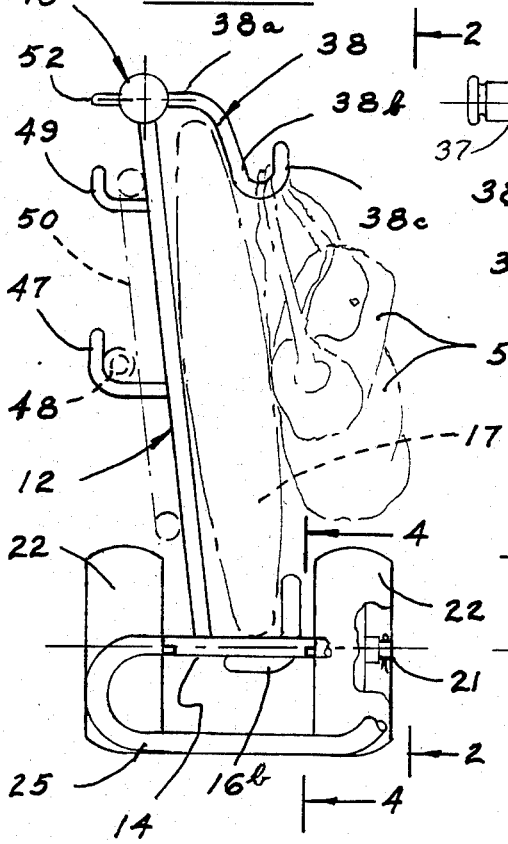
FIG. 2
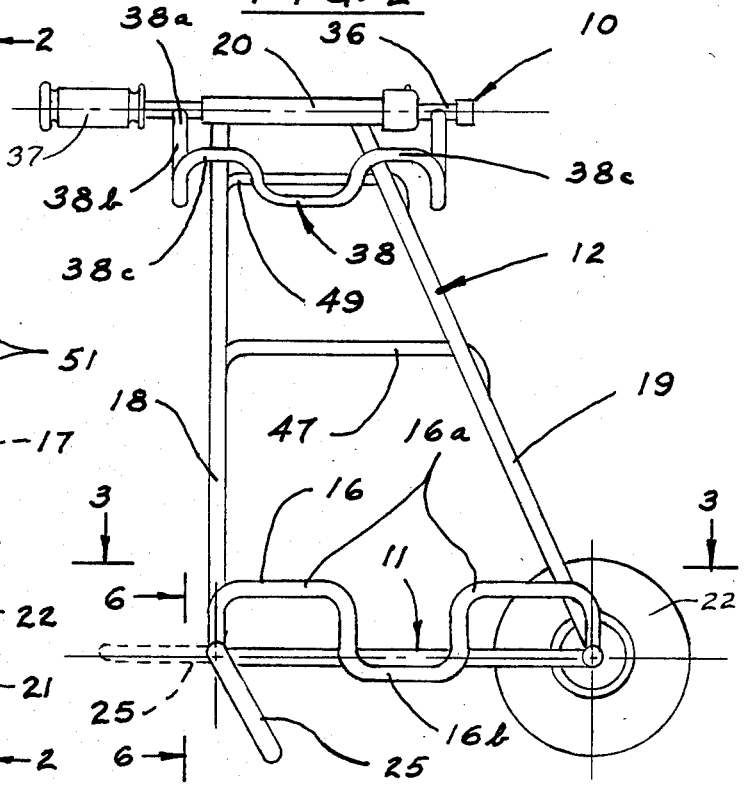
FIG. 3
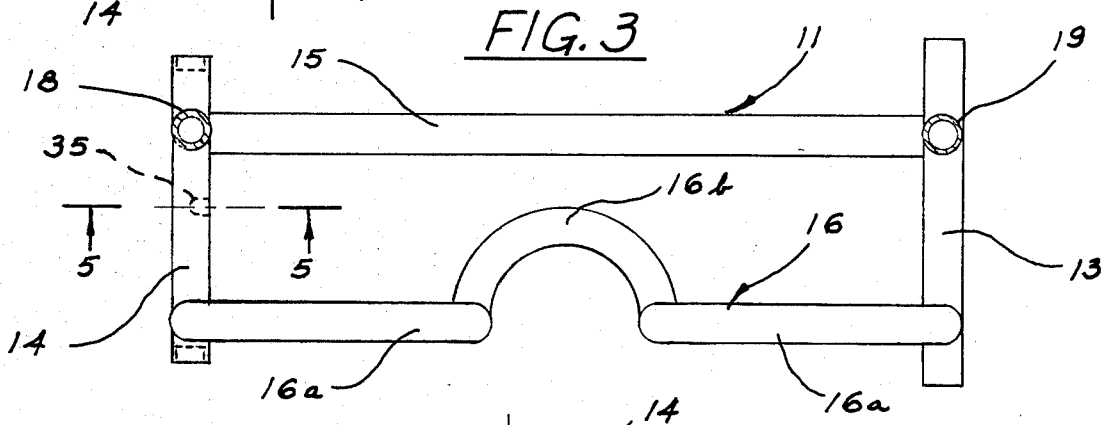
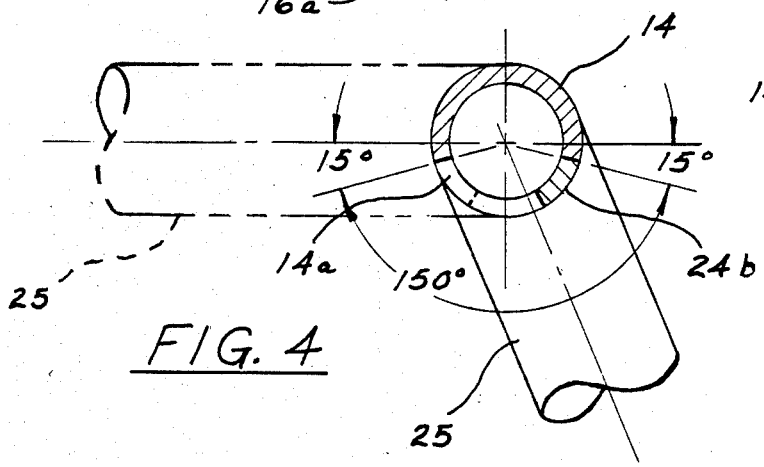
FIG. 4
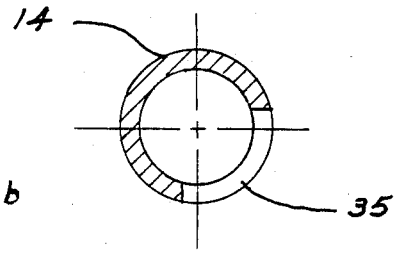
FIG. 5

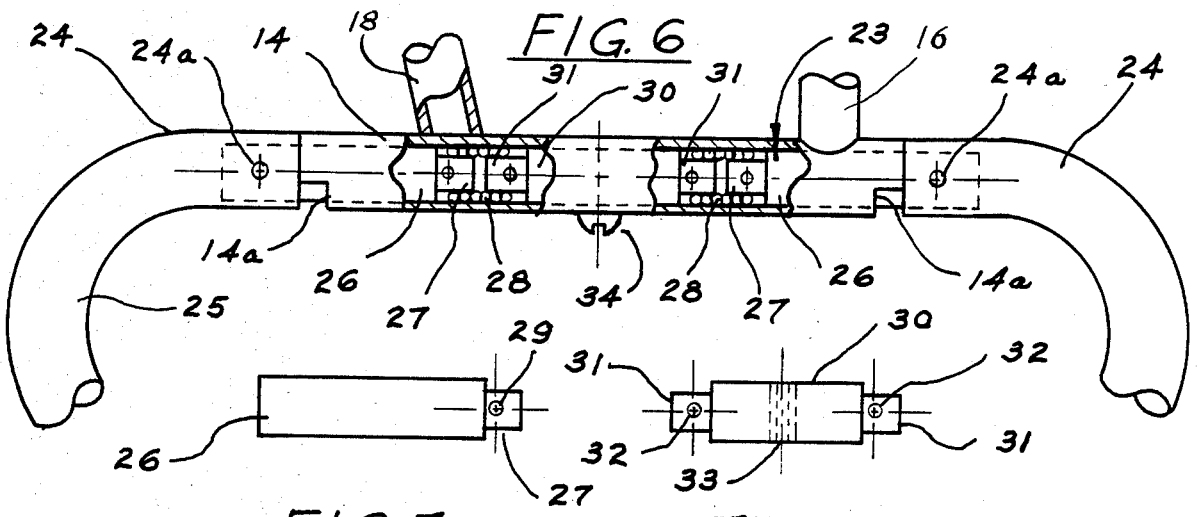
FIG. 6
FIG. 7
FIG. 8
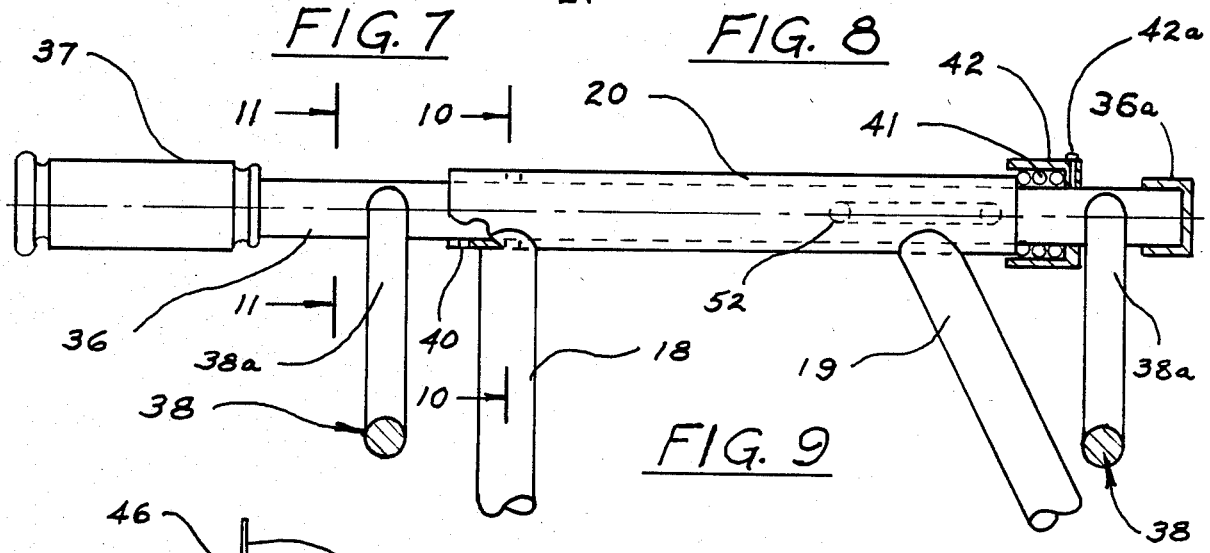
FIG. 9
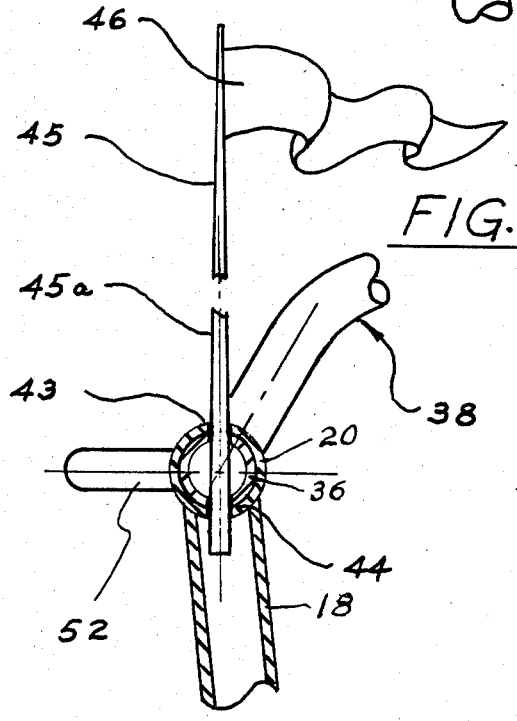
FIG. 10
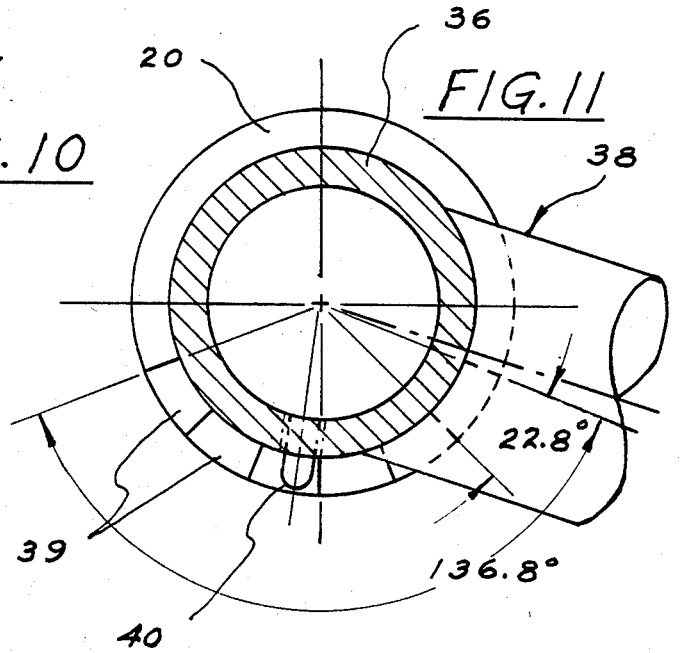
FIG. 11

SAILBOARDING EQUIPMENT VEHICLE

This invention relates to a sailboarding equipment vehicle in the form of a rackcart comprising an upstanding frame elongated at the base in a forward to rearward direction with spaced wheels at the forward end and a kick stand at the rear end of the base, the upstanding portion of the frame being offset slightly from the vertical to provide inclined support for a sailboard having a center edge portion resting on the base of said frame, the upper portion of said frame having an elongated tubular part supporting a longer rotatable member extending front to rear of said frame with a hand grip portion protruding from the rear of the frame, means joined to said rotatable member at portions thereof externally of said tubular part protruding from the board side of the frame having a downwardly offset portion providing a board clamp in one position of rotation thereof, means adjustably supporting said rotatable member in different positions of rotatable adjustment, outer extremities of said board clamp providing hook portions for suspending equipment from said frame, and the upwardly inclined portion of said frame opposed to the board engaging portion thereof having vertically spaced means extending longitudinally of the frame, providing boom and mast racks, whereby all equipment needed for sailboarding can be mounted on, and transported by, said vehicle.

The sport of sailboarding, which in recent years has stimulated considerable interest, creates a significant problem for the enthusiast because of the amount and nature of the equipment which must be delivered to, and assembled at, the water's edge in preparation for participating in the sport. The problem is compounded by the fact that cars or other vehicles bringing enthusiasts and equipment to the water's edge must frequently be parked a considerable distance away, with this distance having to be traversed several times in carrying all of the necessary equipment to the water's edge.

The transport vehicle or rackcart of the present invention is aimed at overcoming this problem by providing in a compact wheeled vehicle, means for supporting in a readily accessible way not only the full equipment for the sailboard per se, i.e. the board, mast, boom, sails and auxilary equipment, but also the special gear needed by the enthusiast, i.e. wet suit, life jacket and miscellaneous personal items.

A preliminary patent search has failed to bring to light any prior patents having direct bearing on the transport vehicle or rackcart of the present invention. The closest prior art encountered, German Offenlegungsschrift No. 26 33 149 relating to a transporter for surf boards and French Pat. No. 2,488,205 relating to a sail-board transporting trailer, teach only means for providing wheeled support for one end of a surf board or sailboard which require the holding of the opposed end of the board in use and manipulation of the wheeled device. There is nothing whatever in these patent disclosures to suggest the free standing transport vehicle of the present invention which, in a compact and balanced way, supports the needed sailboarding equipment and personal gear, and which in use is manipulated by a hand grip portion of the vehicle.

Considered in certain of its broader aspects the sailboarding equipment vehicle or rackcart of the present invention comprises an elongated base frame providing at the forward end a support member for transversely spaced wheels and at the rear end a support member for a pivotally movable kick stand adapted in one position of movement to support the base frame in a horizontal position, and in the other position of movement to be in substantial alignment with the base frame providing clearance for moving the vehicle over uneven ground. The means joining said supports include means at one side of the base frame, and projecting upwardly from the plane thereof, for restraining lateral movement of an engaged surf board. Upwardly extending from a transversely central portion of the base frame is an upstanding frame inclined slightly away from a perpendicular to said base frame in a direction away from said board restraining means. The upstanding frame is defined by a rear member secured to the kick stand support member which in side elevation is perpendicular to the base frame, and a front member secured to the wheel support member, which in side elevation is inclined toward said rear member with the upper ends thereof being joined by an elongated tubular member comprising a handle sleeve parallel to the plane of the base frame.

The tubular member telescopically supports an elongated hand control member longitudinally and rotatably movable in said tubular member and having a hand grip portion rearwardly of said tubular member. Secured to said hand control member at points spaced from the ends of said tubular member is an irregularly contoured board clamp movable in rotation of said hand control member from an operative position in engagement with a sailboard resting against said inclined frame to an inoperative position permitting free movement of the board away from said frame. The outer extremity of said board clamp is fashioned to provide, when in operative position, a plurality of hook members for the hanging of sail bags and other gear and equipment.

Approximately midway of the height of said inclined frame and at the side thereof opposed to the board engaging side is an elongared hook frame parallel to the base frame providing a mast support above which is a second hook frame, also parallel to the base frame, providing support for the boom.

The positioning of the inclined frame and the size of the mast and boom supports is such that the center of gravity of the equipment and gear mounted on the rackcart will be approximately midway between the wheels, thus assuring stability of the loaded vehicle both when standing and being moved from place to place.

The hand control member is provided with spring actuated means for supporting the board clamp in various desired positions of adjustment, thus assuring proper support of the board when moving the vehicle, while permitting free movement of the board in desired loading and unloading operations.

The overall dimensions of the rackcart, approximately 3-feet in height, less than 30-inches in front to rear dimension at the top and bottom and approximately 16-inches in width at the wheel and kick stand portion of the base, is such that the rackcart can easily be carried in station wagons or in the trunks of many automobiles so that it provides a highly practical piece of equipment for assisting the sailboarding enthusiast in the transport of equipment from parking lots to the water's edge.

Novel features of the sailboarding equipment vehicle or rackcart of the present invention will be more fully understood from a consideration of the following description having reference to the accompanying drawing in which the various parts of the device are identified by suitable reference characters in the several views, and in which:

FIG. 1 is an elevation view of the rackcart of the present invention as seen from the rear of the device.

FIG. 2 is a side elevation view of the device taken in the direction of the arrows 2—2 in FIG. 1.

FIG. 3 is a fragmentary view taken substantially along the line 3—3 of FIG. 2 showing the base frame of the device.

FIG. 4 is a fragmentary view substantially on the line 4—4 of FIG. 1.

FIG. 5 is a sectional view substantially on the line 5—5 of FIG. 3.

FIG. 6 is an enlarged showing of a portion of the kick stand structure as shown in FIG. 1 with part of the structure broken away and in section.

FIG. 7 is a detail view of one of the internal end parts as shown in FIG. 6.

FIG. 8 is a detail view of an internal central part as shown in FIG. 6.

FIG. 9 is an enlarged view of the upper portion of the device as shown in FIG. 2 with parts of the structure broken away and in section.

FIG. 10 is a fragmentary view substantially on the line 10—10 of FIG. 9.

FIG. 11 is an enlarged fragmentary view taken on the line 11—11 of FIG. 9.

As shown in FIGS. 1-3 of the drawing the rackcart 10 of the present invention comprises a rigid frame structure providing a base frame 11 and upstanding frame 12 fashioned from appropriate lengths of metal tubing, suitably aluminum tubing, which have been welded together to form the rigid structure.

The base frame 11 is formed of a front member 13 providing a wheel support, a rear member 14 providing a kick stand support, a horizontal connecting member 15 in substantial alignment with the upstanding frame part 12 and a second connecting member 16 of irregularly formed configuration as shown to provide portions **16*a* extending above the base frame 11 to provide a stop for the edge of an engaged sailboard 17 as shown in FIG. 1. The irregularly contoured member 16 also has a central inwardly extending portion 16*b* slightly below the plane of the base frame 13 providing clearance for insertion of a hand when grasping the lower edge of a sailboard 17** in mounting or dismounting the same with respect to the rackcart.

The upstanding frame 12 comprises a rear vertical member 18 joined to the member 14, and perpendicular to base frame 11 as seen from the side in FIG. 2, a forward vertical member 19 joined to the member 13 and disposed at an angle inclined toward the rear member 18 as seen in FIG. 2, with the upper ends of the members 18 and 19 being joined by a tubular member 20 of slightly larger diameter than the other structural members, which is parallel to base frame 11 and provides a handle sleeve for the frame structure. Suitably the handle sleeve 20 is fashioned from 1-inch I.D. aluminum tubing while other frame parts are fashioned from ¾-inch I.D. aluminum tubing.

As clearly shown in FIG. 1 of the drawing, the upstanding frame 12 is inclined from the vertical to the extent of 8.5°-9° in a direction away from the board stop projections **16*a*. This inclination of the upright frame 12 is important not only to provide stability of the sailboard 11** during loading and unloading of the rackcart, but also to provide proper orientation of the center of gravity of the loaded rackcart during movement from place to place.

The forward member 13 of the base frame coaxially supports an axle 21 on which wheels 22 are mounted in a conventional manner. The wheels 22 preferably carry balloon-type inflatable tires providing a broad tread and a diameter of at least 10-inches to facilitate easy rolling of the loaded rackcart over irregular surfaces.

The base frame member 14 coaxially supports a composite axle structure 23 which is in telescopic engagement with spaced ends 24 of a loop-shaped kick stand member 25 which, as shown in FIG. 2 of the drawing, is movable from the operative position for rackcart support as shown in full lines to the inoperative position shown in dotted lines which is the position of choice when the rackcart is being moved from place to place.

The composite axle 23 comprises two shaft members 26 adapted to enter kick stand ends 24 as shown and having reduced ends 27 to accommodate coil springs 28, one end of which interlocks with a transaxial aperture 29 in the reduced portion 27. The shaft members 26 are keyed against rotation in the kick stand ends 24 by pins **24*a*. Centrally of the assemblage 23 is a short shaft member 30 having reduced end extensions 31 and transaxial apertures 32 for engagement with other ends of the coil springs 28. Centrally of the shaft 30 is a threaded transaxial aperture 33 receiving a screw 34 which passes through the semi-circumferential aperture 35 in frame part 14 as shown in FIGS. 3 and 5. It will be apparent that movement of the screw 34 in the aperture 35 to rotate the shaft member 30 will provide variable tension in the oppositely wound coil springs 28 and that desired tension in the kick stand action can be attained by loosening, adjusting and retightening screw 34**.

The degree of movement of the kick stand as shown in FIGS. 2 and 4 is provided by the interfitting end structures on the frame part 14 and the kick stand ends 24. Ends of the frame part 14 are provided with cut outs **14*a* extending through an angle of approximately 150° interfitting with which is a projection 24*b*, as shown in section in FIG. 4 on each of the kick stand ends 24. With the interengagement of the projections 24*a* in the cutouts 14*a* controlling the extent of movement of the kick stand 25, it will be apparent that the tension applied to the springs 28 by adjustment of the screw 34 should be such as to support the kick stand 25 in the dotted line position when movement of the rackcart is desired. This tension is increased as the kick stand 25** is rotated to the full line position which is maintained by the weight of the rackcart until released by lifting the rear end of the rackcart.

Coaxially of the handle sleeve 20 and rotatably and longitudinally movable therein is an elongated handle 36 terminating at one end in a hand grip 37 and suitably having at the other end a closure cap **36*a*. Secured to the handle 36 at points outwardly of the handle sleeve 20 are ends 38*a* of a board clamp 38 which is irregularly formed to provide a downward extension 38*b* and upwardly extending hook parts 38*c*. The contour of the board clamp 38 is such as to overlap the upper edge of an engaged sailboard 11 as shown in FIG. 1 while being easily raised to inoperative position as shown in FIG. 10 by rotation of the handle 36** when mounting or dismounting of the sailboard on the rackcart is desired.

To support the board clamp 38 in desired positions of adjustment, the end of handle sleeve 20, adjacent the hand grip 37, is provided with a series of circumferentially spaced notches 39 engageable by a pin 40 fixedly secured to, and projecting from, the handle 36. Engagement of the pin 40 with selected notches 39 is provided by compression spring 41 arranged around handle 36 in engagement with the opposite end of the handle sleeve 20 and housed within a spring retainer 42 which bears against the adjacent end 38*a* of the board clamp. Tension in the compression spring 41 can be increased by moving the spring retainer 42 away from clamp board end 38*a* and securing it in the desired position by means of set screw 42*a*. It will be apparent that pulling on the hand grip 37 acts to compress coil spring 41 to thereby disengage pin 40 from a notch 39 permitting counterclockwise rotation of the handle 36.

A preferred size and arrangement of notches 39 has been shown in FIG. 11 of the drawing wherein movement of pin 40 from one notch to the next subtens an angle of about 22.8°.

As shown in FIG. 10 of the drawing, the board clamp 38 is raised to an operative position. At this position of rotational orientation of the handle 36 in the handle sleeve 20, it is desirable, in alignment with frame part 18, to drill vertically aligned apertures 43,44 while spring 41 is compressed to engage the lower end 45*a* of an elongated, tapered rod 45, suitably about 6-feet long, carrying a characteristic banner 46. While the provision of a banner support does not contribute to the transporting function of the rackcart, the mounting of the banner prior to a session of surfsailing can provide a helpful means for relocating equipment at the end of an outing.

Assembly of the handle spring mechanism above-described warrants brief discussion. The handle 36 is passed through the sleeve 20, spring 41 and spring retainer 42 and a jig is applied to the outer end of the spring retainer 42 and opposed end of the sleeve 20 to compress spring 41. This provides clearance to permit welding of the board clamp ends 38*a* at the appropriate points longitudinally of the handle 36, with the spring 41 becoming operative and functional after removal of the restraining jig.

Additional components of the rackcart comprise three hook members secured to the frame 12 at the side thereof opposed to the board engaging side. An irregularly contoured member 47 is joined to the frame parts 18,19 approximately midway of the height of the frame 12 and parallel to the base frame 11 providing an elongated hook for supporting a mast 48. A similar and somewhat smaller hook member 49, higher in the frame 12 and also parallel to the base frame 11, provides support for a boom 50. The hook portions 38*c* of the board clamp provide means for supporting bags 51 carrying sails and other equipment. Thus it will be apparent that the rackcart uniquely provides for the carrying of all equipment needed by the sailboarding enthusiast.

The third hook member 52, which as shown in FIGS. 1, 9 and 10, is a small loop protruding from the handle sleeve 20, provides means for hanging the rackcart against a garage wall or other vertical surfaces for storage purposes. As clearly shown in FIG. 1 the outer extremities of hook members 47, 49 and 52 are in substantially perpendicular planar alignment with the outer extremities of wheel 22 and kick stand 25 at the one side of the rackcart. This alignment permits the rackcart to be compactly stored, flush against a wall, with all sailboarding equipment in place, whether resting on the wheels and kick stand or hanging on the wall by hook 52.

The essentially co-planar orientation of parts at the one side of the rackcart has the further advantage of permitting the rackcart to be securely mounted on top of a vehicle when inside storage space is not available.

Various changes and modifications in the sailboarding equipment vehicle or rackcart as herein disclosed may occur to those skilled in the art; and to the extent that such changes and modifications are embraced by the appended claims, it is to be understood that they constitute part of the present invention.

I claim:

1. A sailboarding equipment vehicle in the form of a rackcart comprising a base and an upstanding frame elongated in a front to rear direction, said base having spaced wheels at the front end and a kick stand at the rear end of the base, the upstanding portion of the frame being offset slightly from the vertical to provide inclined support for a sailboard having a center edge portion resting on the base of said frame, the upper portion of said frame having an elongated tubular part extending from the front to the rear of said frame, said tubular part supporting a longer rotatable member with a hand grip portion protruding from the rear of the frame, means joined to said rotatable member at portions thereof externally of said tubular part protruding from the board side of the frame and having a downwardly offset portion for providing a board clamp in one position of rotation thereof, means for releasably securing said rotatable member in different positions of rotatable adjustment, said board clamp having offsets providing hook portions for suspending equipment from said frame when in the board clamping position, and the upwardly inclined portion of said frame on the side opposed to the board engaging portion thereof having vertically spaced means extending longitudinally of the frame for providing boom and mast racks, whereby all equipment needed for sailboarding can be mounted on and transported by said vehicle.

2. A sailboarding equipment vehicle as defined in claim 1, wherein the base of said frame includes a low upstanding board retaining means spaced from, and essentially parallel to, the upstanding portion of said frame.

3. A sailboarding equipment vehicle as defined in claim 2, wherein said board retaining means is an irregularly contoured member fixedly secured to front and rear portions of said frame base, and the central portion of said member being offset downwardly and in the direction of said upstanding frame portion to provide hand access for gripping a board edge during sailboard loading and unloading operations.

4. A sailboarding equipment vehicle as defined in claim 1, wherein the extremities of the wheel, kick stand, mast hook and boom hook are in substantially coplanar alignment perpendicularly with respect to the wheel axle, thereby providing compact storage of the vehicle against a vertical surface.

5. A sailboarding equipment vehicle as defined in claim 4, wherein a third hook member, secured to said upper tubular frame part, and sharing in said coplanar alignment, provides means for hanging said vehicle on a vertical surface for storage purposes.

6. A sailboarding equipment vehicle as defined in claim 1, wherein said kick stand is axially spring tensioned to be normally supported in an elevated, essentially horizontal position, said kick stand being rotatably movable against the spring tension through an angle somewhat greater than 90° to a vehicle supporting position, and said kick stand being retained in such supporting position by the weight of the vehicle until being automatically released by the raising of the rear end of said vehicle.

7. A sailboarding equipment vehicle as defined in claim 6, wherein said kick stand is an open loop having spaced upper ends adapted to coaxially align with a transverse tubular portion of the base frame, interfitting means on said spaced end and on ends of said tubular portion providing stop means restricting the extent of rotatable movement of said kick stand.

8. A sailboarding equipment vehicle as defined in claim 7, wherein said spring tensioning is provided by a compound axle structure comprising short shaft members secured to said kick stand ends joined by reversely wound coil springs to a central shaft member rotatable within said tubular portion of the base frame, and said tubular portion having a semi-circumferential slot receiving a clamp screw carried by said central shaft member, and the degree of spring tensioning is varied by loosening, moving and retightening said clamp screw.

9. A sailboarding equipment vehicle as defined in claim 1, wherein the means for releasably securing said rotatable hand grip member in different positions of rotatable adjustment comprises a pin projecting from said rotatable member registering with circumferentially spaced notches in the rear end of said upper tubular frame part, and a coil spring around said rotatable member, said coil spring being housed within a spring retainer and exerting pressure against the forward end of said tubular frame part to normally support said pin in engagement with one of said slots, and rotary adjustment of said board clamp being accomplished by rearward pulling on said hand grip to compress said coil spring and disengage said pin.

10. A sailboarding equipment vehicle as defined in claim 9, wherein said spring retainer carries a set screw for clamping said retainer in different longitudinal positions on said rotatable member for adjusting the tension in said coil spring.

* * * * *